US005628355A

United States Patent [19]

Gist

[11] Patent Number: 5,628,355

[45] Date of Patent: May 13, 1997

[54] WINDOW SAFETY SYSTEM FOR A CHILD OR THE LIKE AND A METHOD OF MANUFACTURING THEREOF

[76] Inventor: Lanny Gist, 96 Friendship La. Lot 17, Beaufort, S.C. 29902

[21] Appl. No.: 401,001

[22] Filed: Mar. 9, 1995

Related U.S. Application Data

[63] Continuation-in-part of Ser. No. 264,665, Jun. 23, 1994, Pat. No. 5,492,164.

[51] Int. Cl.[6] ..... E06B 3/32

[52] U.S. Cl. ..... 160/102; 49/54; 49/65

[58] Field of Search ..... 160/102, 201, 160/218, 130, 264, 274, 405; 49/50, 54, 55, 65

[56] References Cited

U.S. PATENT DOCUMENTS

| | | | |
|---|---|---|---|
| 993,654 | 5/1911 | Conant | 160/102 |
| 1,552,612 | 9/1925 | Kelley | 160/102 |
| 1,908,919 | 5/1933 | Reed | 160/102 |
| 2,422,840 | 6/1947 | Mayer | 160/102 X |
| 5,458,178 | 10/1995 | Nakamura | 160/172 V |

*Primary Examiner*—David M. Purol

*Attorney, Agent, or Firm*—Bradford E. Kile

[57] ABSTRACT

A window safety system having a first and second vertical track installed as mirror images on opposite sides of a window frame. The system utilizes at least one elongate blocking element which extends across the window width and is secured to opposing guide elements which smoothly travel within the vertical tracks. A system cover is engaged at opposite ends to guide elements which travel in the vertical tracks. The guide elements are connected in series to one another by a flexible belt within the vertical tracks. The system cover interacts with a lower rail of a window sash such that when the window sash is raised to an open position, the system cover travels with the lower sash. This travel in turn causes the guide elements to translate within the vertical tracks and guiding blocking rods to a position laterally across the opening of the window. The blocking rods thereby prevent egress of a child or the like through the open window. When the window is closed a reverse sequence occurs and the blocking rods are nested beneath the cover upon the window sill.

25 Claims, 8 Drawing Sheets

WINDOW SAFETY SYSTEM FOR A CHILD OR THE LIKE AND A METHOD OF MANUFACTURING THEREOF

This application is a continuation-in-part of application Ser. No. 08/264,665, filed Jun. 23, 1994; now U.S. Pat. No. 5,492,164.

BACKGROUND OF THE INVENTION

The present invention relates to a window safety system for use in conventional windows having upper and lower window sashes. More specifically, the invention is directed to an improved window safety system which interacts with a lower window sash such that as the lower window sash is raised, the safety system automatically places at least one blocking element across the window opening to operably prevent a small child, mentally impaired adult, pet or the like from falling through the window opening.

Opening windows to obtain fresh ambient air is appealing and pleasurable in warm weather seasons. In multi-story homes and buildings, however, open windows can be problematic and present a potential safety hazard. In this, an open window is an inescapable attraction to a child, a mentally impaired adult or a pet who approaches the window opening to gaze outside. Disaster may strike if the child climbs onto an open window sill or even leans out a window to look down. Any fall is almost certain to result in death or serious bodily injury. Moreover, the secondary emotional trauma to a parent attendant such a tragedy is debilitating.

The dangers associated with an open window has lead to a number of proposed solutions. Many residential apartment buildings have converted to sealed windows having a small vent which may be opened to allow fresh air to enter the living space. The obvious disadvantages associated with these window systems is that the window can not be opened at all and such systems are clearly a fire hazard.

Other prior art safety systems utilize a permanently installed bar cover which is screwed into the frame of the window. This system has several limitations. First, it is very unattractive to have permanently installed bars covering a window opening. Second, the fastening elements which are needed to secure a bar cover to a window frame may cause extensive damage to the frame. Third, these permanent bars create a prison atmosphere and block any egress which may be necessary in the event of a fire or other emergency.

Another prior art attempt utilizes a plurality of telescopic rods or collapsible scissor bars which have one end secured to the window sill and the other end secured to a window sash. When the window sash is raised to an open position, the rods or bars extend and cover the window opening. This system has several recognized difficulties. First, the presence of the rods is obvious whether the window is open or closed which detracts from the aesthetic appearance of the window. Second, the telescopic rods are an expensive addition to the window system and are not easily manufactured. Third, the system must be screwed into the window sash and sill which causes permanent damage to the window and surrounding frame.

Another prior art attempt utilizes a plurality of bars which are secured to the underside of the lower rail of a lower window sash. When the lower window sash is in a closed position, the bars are housed beneath the window sill in an adjacent wall. As the lower window sash is raised the bars are raised into the window opening thereby providing a safety feature. Several disadvantages are recognized. First, this system involves major alterations to the window system and surrounding walls in order to house the bars. Second, the system is a costly alternative to prior art safety systems. Third, the system causes permanent damage to the window sash and frame.

Yet another prior art attempt utilizes a bar system which travels in vertical guides secured to the window frame. As a window is opened the bars occupy the opening. This prior art attempt utilizes a plurality of runners which guide an attached bar. This complex system has several recognized limitations. First, the system utilizes complex parts which increases the difficulty of installation and increases the production cost. Second, the system does not provide a means for housing the bars when the window is in a closed position. Third, the system provides no easy and convenient way to disengage the safety system when not needed. Fourth, the system requires major alterations to an existing window structure.

The difficulties and limitations suggested in the preceding are not intended to be exhaustive, but rather are among many which demonstrate that although significant attention has been devoted to window safety systems, such systems appearing in the past will admit to worthwhile improvement.

OBJECTS AND BRIEF SUMMARY OF THE INVENTION

It is therefore a general object of the invention to provide a novel window safety system which will obviate or minimize difficulties of the type previously described.

It is another general object of the invention to provide a novel window safety system which will effectively block accidental egress by a child, mentally impaired adult, pet or the like from an open window.

It is a specific object of the invention to provide a window safety system which may be easily installed in existing windows without the need for permanent alteration of the window structures.

It is another specific object of the invention to provide a window safety system which may be easily installed in existing windows having a variety of different designs and dimensions without increasing system manufacturing cost.

It is another object of the invention to provide a window safety system which operates automatically when a lower window sash is raised to open the window.

It is still another object of the invention to provide a window safety system which does not detract from the aesthetic appearance of the window and which can not be observed when the lower window sash is in a closed position.

It is yet another object of the invention to provide a window safety system which contains a limited number of parts and may be manufactured at an economical cost per unit.

It is still yet another object of the invention to provide a window safety system wherein the guiding components of the system can be manufactured as a single unit in a direct molding process.

It is still yet another object of the invention to provide a window safety system which may be securely installed in a window structure and provides safe and reliable protection against accidental falling through an open window.

It is yet another object of the invention to provide a window safety system which may be quickly and easily deactivated by an adult in an emergency to free the window opening and allow egress.

BRIEF SUMMARY OF A PREFERRED EMBODIMENT OF THE INVENTION

A preferred embodiment of the invention which is intended to accomplish the foregoing objects includes a window safety system having a first and second vertical track installed as mirror images on opposite sides of a window frame. The system utilizes at least one elongate blocking element that extends across the window width and is secured to opposing guide elements which smoothly travel within the vertical tracks. A system cover engages at its opposite ends guide elements which travel in the vertical tracks. The system guide elements are operably connected in series to one another within the vertical tracks by a flexible belt. When the safety system is activated, the system cover interacts with a lower rail of a window sash such that when the window sash is raised to an open position, the system cover travels with the lower sash, which in turn, causes the guide elements to translate within the vertical tracks thereby guiding blocking elements to a position laterally across the opening of the window. When the window is closed a reverse sequence occurs and the blocking elements are nested beneath the cover upon the window sill.

DRAWINGS

Other objects and advantages of the present invention will become apparent from the following detailed description of a preferred embodiment thereof taken in conjunction with the accompanying drawings, wherein.

DETAILED DESCRIPTION

Context of the Invention

Figure 1:
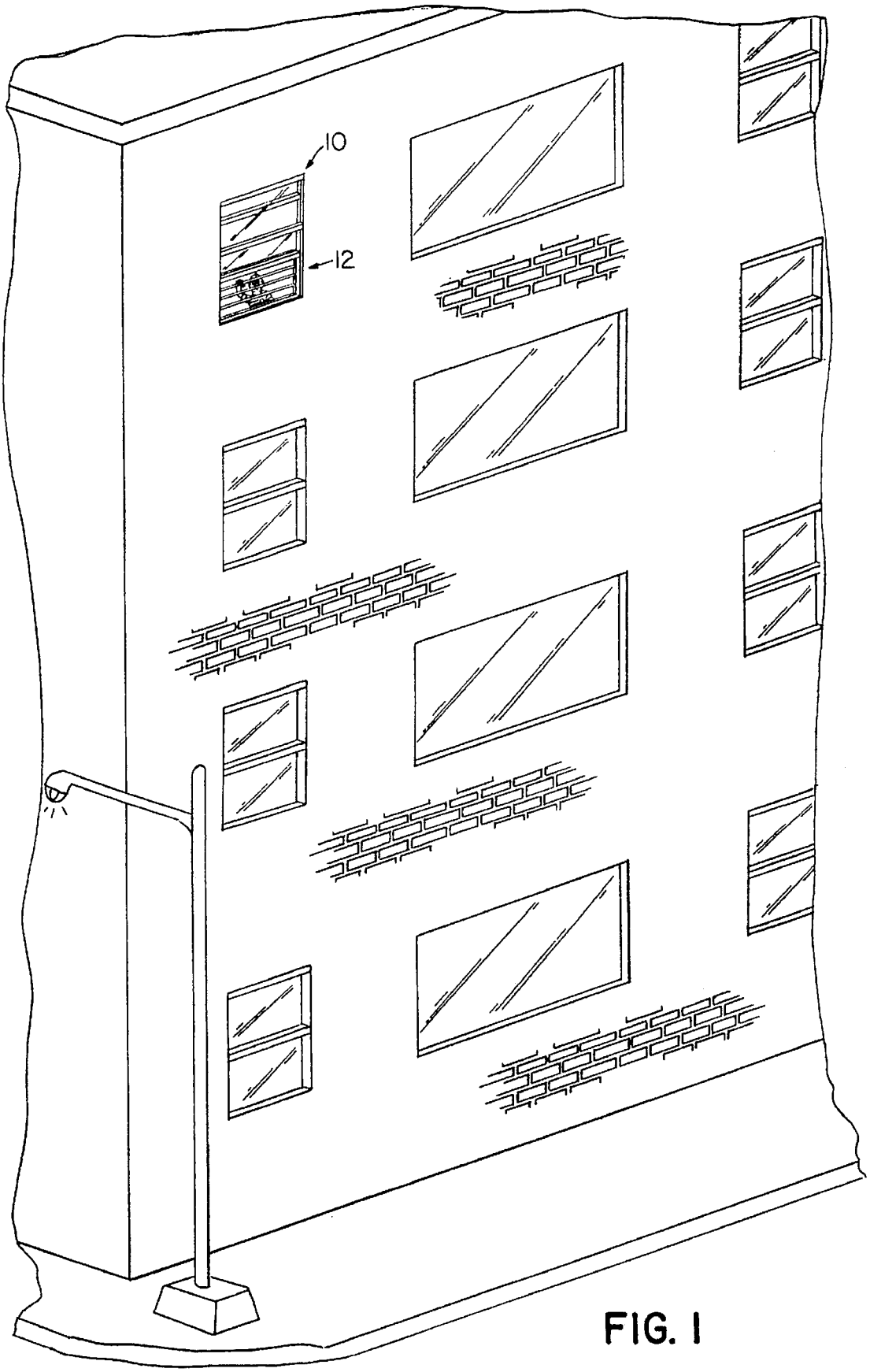
FIG. 1 is a perspective view showing an apartment building or hotel with an upper level window having a safety system of the present invention installed.

Referring now to the drawings and particularly to FIG. 1, there is shown a high rise apartment or office building or hotel with a window 10 utilizing a safety system 12 of the present invention. As schematically illustrated it is not unusual for a child or the like to be drawn to an open window to look out and even attempt to lean out and/or climb up onto an open window sill. Once on the window sill tragedy is only a moment away. The subject invention is designed to effectively prevent such tragedy while affording all occupants the benefits of an open window environment.

Window Safety System

Figure 3:
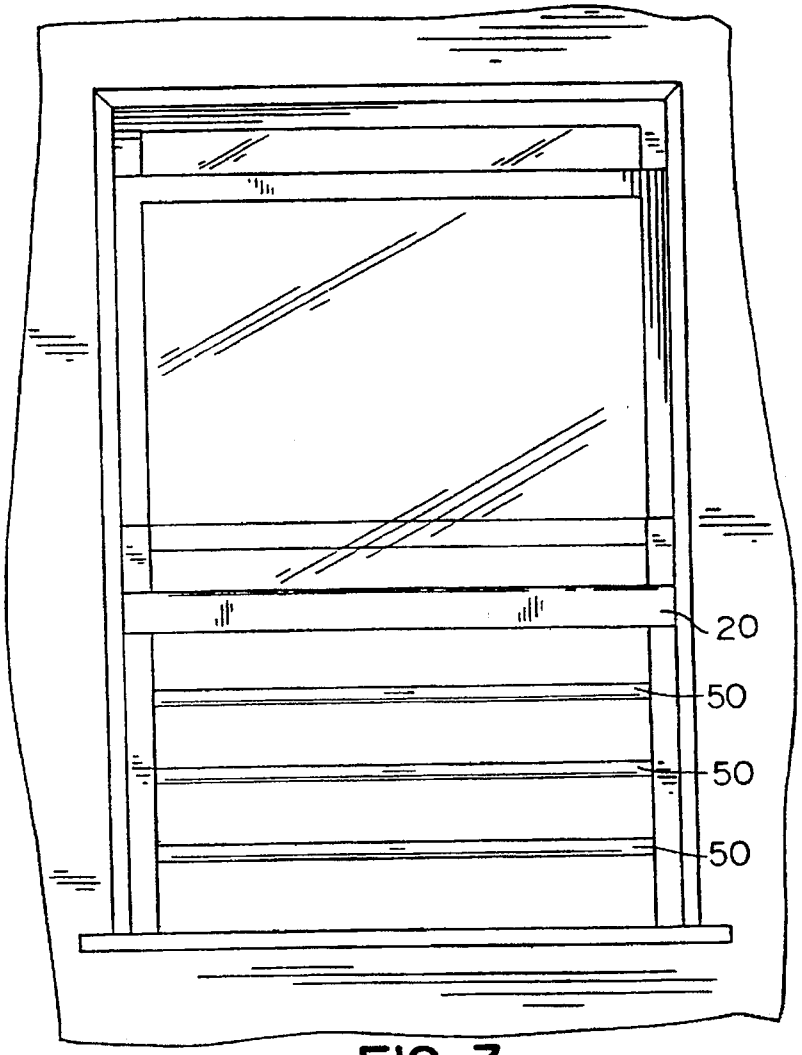
FIG. 3 is a front view of a window in an open position with the safety system of the present invention shown in an operative blocking position.
Figure 2:
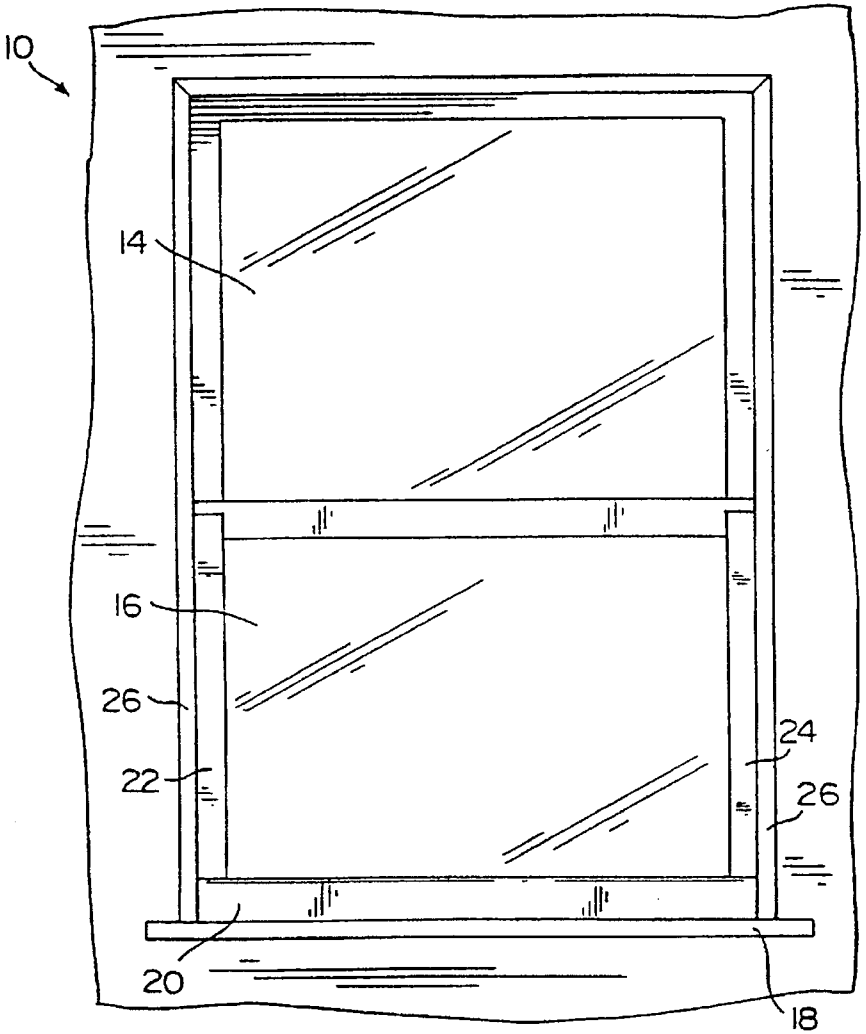
FIG. 2 is a front view of a window in a closed position with the safety system of the present invention installed.

FIG. 2 discloses a window 10, such as previously depicted in FIG. 1, having an upper sash 14, lower sash 16, frame 26, and sill 18. The lower sash 16 of window 10 is in a lowered closed position as depicted in FIG. 2. In normal operation, when it is desired to open the window, the window is simply grasped by a portion of the lower sash 16 and lifted upward until the desired amount of opening is achieved. The lower sash 16 of window 10 is in a raised open position as depicted in FIG. 3. A system cover 20 houses the components of the system when the window sash 16 is in a lowered and closed position. This allows the window to remain aesthetically attractive even when the safety system 12 of the present invention is installed. The safety system 12 includes a first elongate vertical track 22 and a second vertical elongate track 24 secured to opposing inner sides of frame 26 of the window 10.

Figure 4:
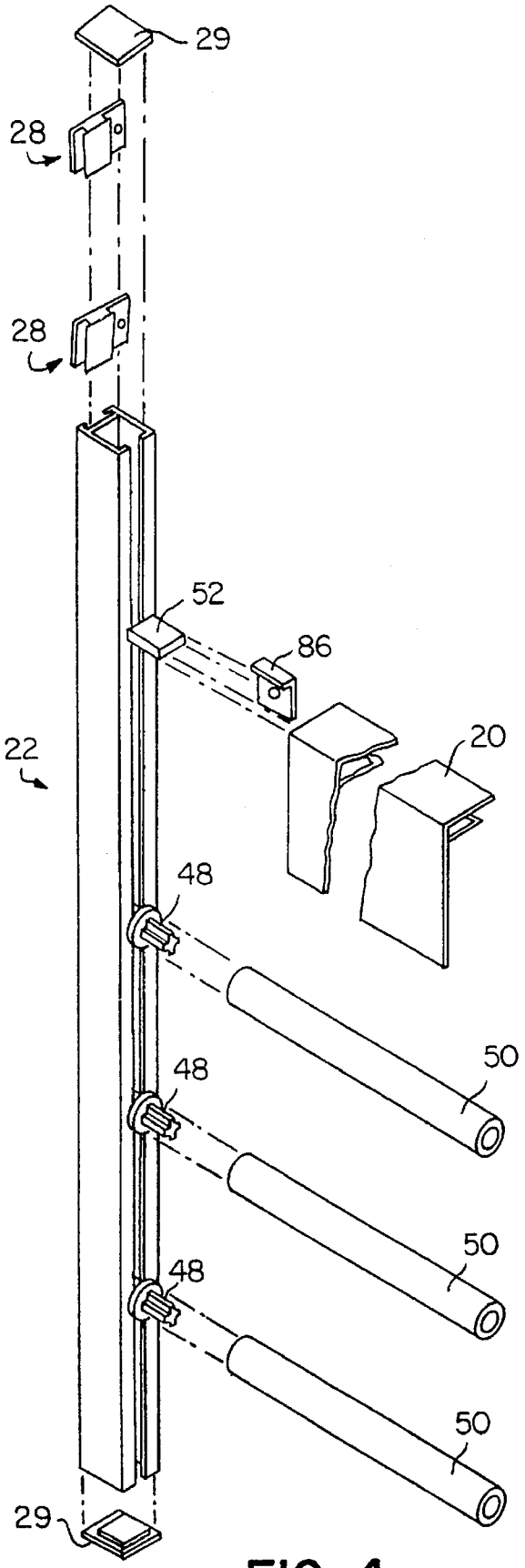
FIG. 4 is a perspective, partially exploded view of a vertical track of the window safety system of a preferred embodiment of the present invention.

Referring now to FIG. 4, there is shown an exploded view of the first 22 or second 24 vertical tracks with system components. It is to be understood that the description with respect to track 22 shown in FIG. 4 is identical to that of track 24 mounted on an opposing side of the window. The vertical tracks 22 and 24 are secured to an inner portion of frames 26 using a plurality of securing plates 28. The securing plates 28 are preferably manufactured from plastic and consist of a lower portion 30 and upper portion 32 that has a reduced throat component. The mounting plate 28 is provided with a screw bore 34 for receiving a screw (not shown) for attachment to an inner portion of frame 26. Alternatively, a self adhering glue and release tape fastening arrangement may be used to secure the lower portion 30 to the inner window frame 26. The vertical tracks 22, 24 are in turn secured to the base plates 28 by sliding a rear mounting channel 36 of the vertical tracks 22 and 24 onto the base element 26 as depicted in FIG. 4. The mounting channel 36 is defined by a pair of mounting prongs 38. This attachment provides a secure and locked relationship between the base plate 28 and the vertical tracks 22 and 24.

The vertical tracks 22, 24 have a sufficient length which permits installation into a window 10 of any conventional height. In a preferred embodiment, a length in the order of 25 inches would be sufficient for most commercial windows. The length of the tracks 22, 24 may be tailored to the specific dimensions of the window 10. Specifically, if the vertical tracks 22, 24 are too long as manufactured, thereby preventing installation in a window 10, the system user facilely cuts through the vertical tracks 22 and 24 along their width for sizing the tracks to the user's window. This design provides for a safety system which may be economically produced while allowing for installation in windows of varying dimensions. An upper and lower track cap 29 is secured at opposing ends of the track 22, 24 to provide for complete housing of the moving components of the system.

Figure 5:
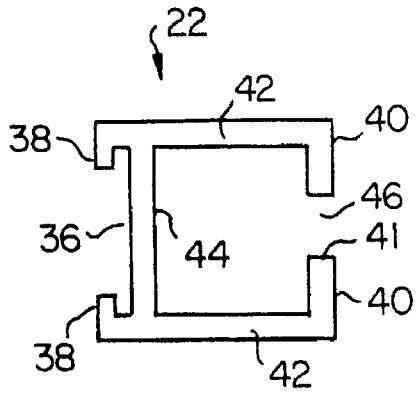
FIG. 5 is a cross-sectional view of a vertical track of the window safety system of the preferred embodiment of the present invention.
Figure 6A:
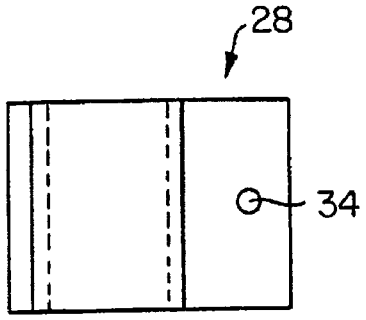
FIG. 6A is a side view of a vertical track mounting element of the window safety system of the preferred embodiment of the present invention.
Figure 6B:
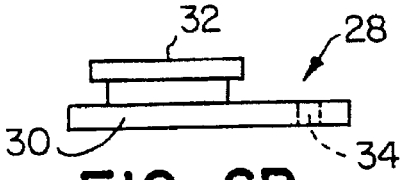
FIG. 6B is a top view of a vertical track mounting element of the window safety system of the preferred embodiment of the present invention.
Figure 7A:
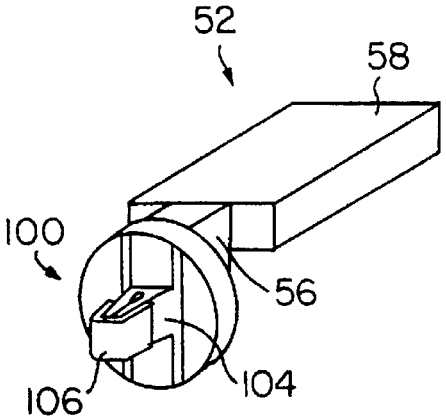
FIGS. 7A–7C are perspective, side, and top views, respectively, of a cover guide element of the preferred embodiment of the window safety system of the present invention.
Figure 7B:
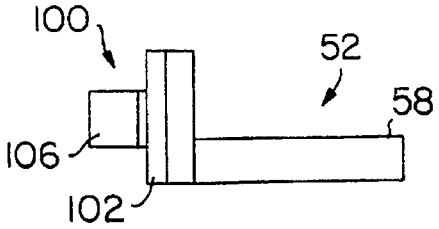
Figure 7C:
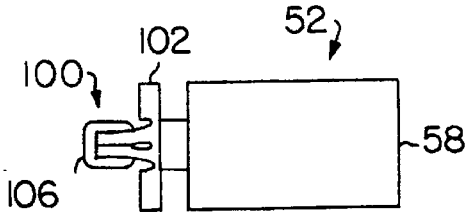

As shown in FIGS. 4 and 5, the vertical tracks further consist of side panels 42, a rear panel 44, and an opening 46 running the length of the track 22. The track 22 is preferably fabricated from plastic in an extrusion process. The track receives at least one and preferably a plurality of guide elements 48 having a connecting belt 96 integrally secured to a portion of the guide elements 48 as described in more detail with reference to FIGS. 10 and 11. The opening 46 is defined by a pair of extensions 40 which protrude from side panels 42 as shown in FIG. 5. The interaction between the pair of extensions 40, the rear panel 44, and the side panels 42 form an inner track guide running along the length of the vertical track.

The safety system includes at least one and preferably three blocking element 50. The particular number of blocking elements 50 utilized will depend on the height of the window in which the safety system is installed. Preferably the blocking elements 50 are tubular members having a first end which interacts with a guide element 48 of track 22 and a second end which interacts with an opposing guide element 48 of the opposing track 24. In the preferred embodiment, the blocking elements 50 are aluminum tubular members formed in an extrusion process and having a length sufficient to span across a window of any width. Alternatively, the blocking elements 50 may be manufactured from plastic or steel. The blocking elements 50 are preferably manufactured with a length in the order of 40 inches which would be sufficient for most window designs. As with the vertical tracks 22 and 24, the length of the blocking elements 50 may be facilely tailored to the specific width of a window 10. Specifically, the system user merely cuts through the blocking elements 50 along their length for adaptation to the user's window. This procedure is accomplished simply and easily by using a standard fine tooth saw or the like.

FIG. 4, 7*a*, 7*b* and 7*c* show a cover guide element 52 of the present invention. The guide element 52 is received within the vertical tracks 22, 24 for motion along the tracks. The guide element 52 comprises a body 100, throat 56, and attachment 58 portion. The guiding element 52 is preferably manufactured from a commercial grade plastic. The body 100 of the cover guide element 52 is constructed to be received within the channel of the track 22, 24 between rear panel 44 of track 22, 24 and extensions 40 and travels within the channel of the track 22, 24. The body 100 preferably has a cylindrical guide portion 102 that cooperates with the surfaces of the track to provide for smooth and easy gliding movement of the guide element 52. The guide element 52 further consist of teeth or prongs 104 that extend from the cylindrical guide portion 102 as clearly shown in FIGS. 7*a* and 7*c*. The guide element 52 further consist of a cap 106 that mates with and receives the teeth 104 for securing a connecting belt therebetween as more completely described with reference to FIGS. 10*a* and 10*b*.

Figure 8A:
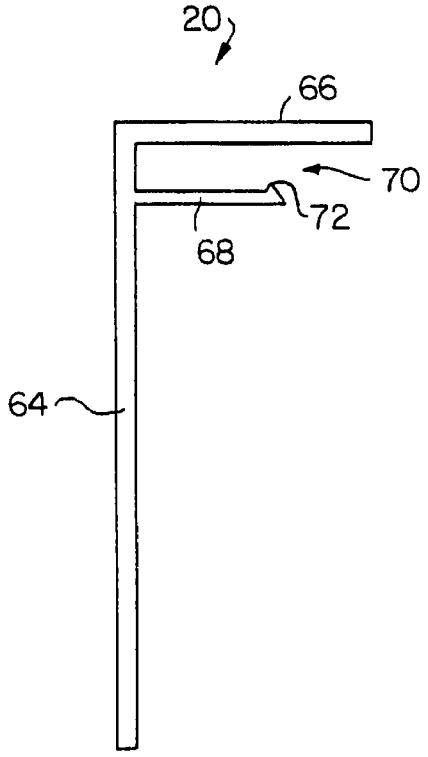
FIG. 8A is a side view of a system cover of the preferred embodiment of the window safety system of the present invention.
Figure 8B:
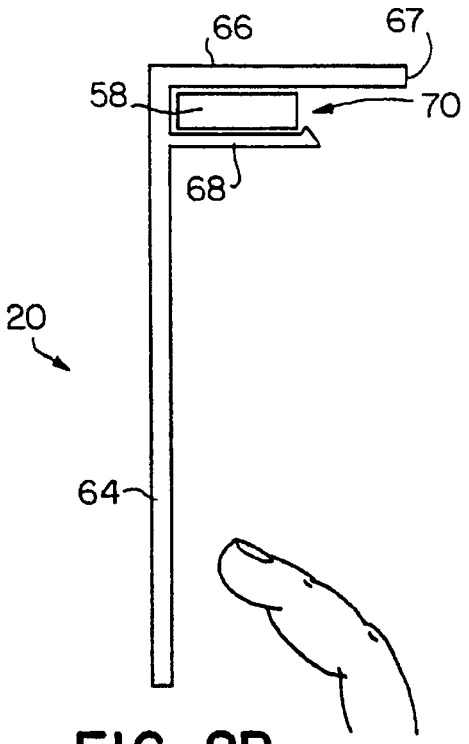
FIG. 8B is a side view of a system cover of the preferred embodiment of the window safety system of the present invention when the safety system has been activated.
Figure 8C:
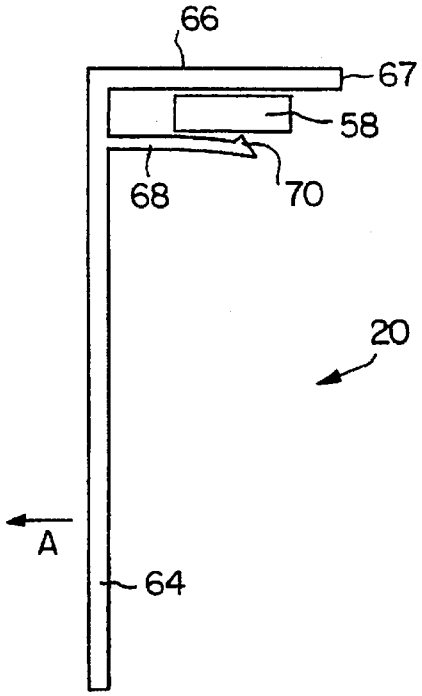
FIG. 8C is a side view of a system cover of the preferred embodiment of the window safety system of the present invention when the safety system is being deactivated by a system user.
Figure 9A:
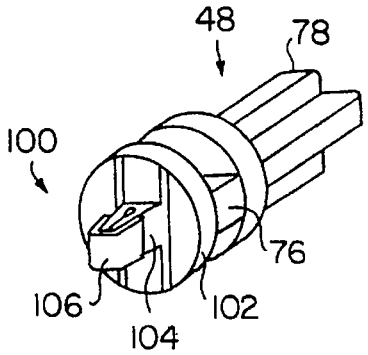
FIGS. 9A–9C are perspective, side, and top views, respectively, of a guide element of the preferred embodiment of the window safety system of the present invention.
Figure 9B:
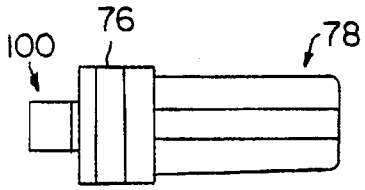
Figure 9C:
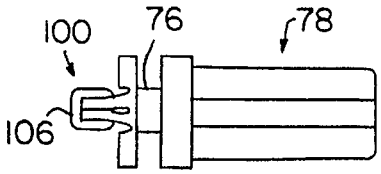

The attachment portion 58 of the cover guiding element 52 operably engages the cover 20 as described below. Preferably, the attachment portion 58 is rectangular in shape in order to provide a locked connection between the guide element 52 and the cover 20 as explained in more detail with reference to FIGS. 8*a*–8*c*. Other shapes which allow for a fitting connection between the guide element 52 and the cover 20 are considered to be within the scope of the invention. The longitudinal surface 41 of extensions 40 of the vertical tracks 22, 24 operably engages the throat portion 56 of the guide 52 in order to maximize guidance and prevent rotation of the guide 52 within the channel of the tracks 22, 24.

Referring to FIGS. 4, 8*a*, 8*b*, and 8*c*, there is shown the system cover 20 of the preferred embodiment. The cover 20 is a generally L-shaped member consisting of a long leg 64, short leg 66 having a distal portion 67, and extension 68. The short leg 66 and the extension 68 cooperate to form a securing channel 70 for receiving the attachment portion 58 of the cover guide element 52. Specifically, the attachment portion 58 snaps into the channel 70 between the short leg 66 and the extension 68 and is locked in position by a lip 72 of the extension 68. The short leg 66 of the cover 20 has a distal extended portion 67 for operable engagement with either the lower sash 16 of a window 10 or a prong secured to the lower window sash 16 as described in more detail below. The cover 20 is preferably manufactured from plastic or alternatively, extruded aluminum. The cover is manufactured having a length of approximately 40 inches which is sufficient for installation in most windows. As with the other primary system components, the length of the cover 20 may be tailored to the specific width of a window 10. Specifically, the system user merely cuts through the cover 20 along its length for adaptation to the user's window. This procedure is accomplished simply and easily by using a standard fine tooth saw or the like.

FIGS. 4, 9*a*, 9*b*, and 9*c* depict the preferred design for the guiding elements 48. Specifically, guide element 48 comprises a body 100, throat 76, and attachment portion 78. The guide element 48 is preferably an integral component manufactured from a plastic. The body 100 is identical in formation to the body 100 of the cover guide element 52 shown and described with reference to FIGS. 7*a*–7*c*. Specifically, body 100 (using identical reference numerals to describe identical part construction) preferably has a cylindrical guide portion 102, teeth or prongs 104, and a cap 106 as described above and further shown and described with reference to FIGS. 10*a* and 10*b*.

The blocking elements 50 cooperate at their ends with the attachment portion 78 of the guide elements 48. In the preferred design, this is accomplished by providing the attachment portion 78 with a cylindrical prong 80 which is force fitted into the end of a tubular blocking element 48. The cylindrical prong 80 is preferably of a groove and ridge design and appears t-shaped in cross-section to allow for easy insertion into the end of the tubular blocking elements 48. Other attachment arrangements between the guiding elements 48 and the blocking elements 50 are considered to be within the scope of the invention.

Figure 10A:
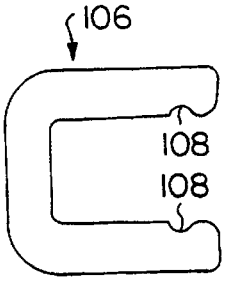
FIGS. 10A is a plan view of a locking cap for engaging grip prongs of the preferred embodiment of the present invention.
Figure 10B:
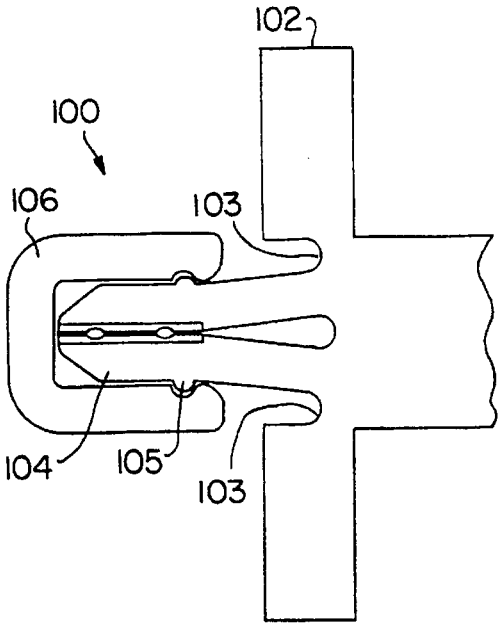
FIGS. 10B is a side view of a portion of a system guide element having a locking cap engaged with grip prongs of the preferred embodiment of the present invention.
Figure 11:
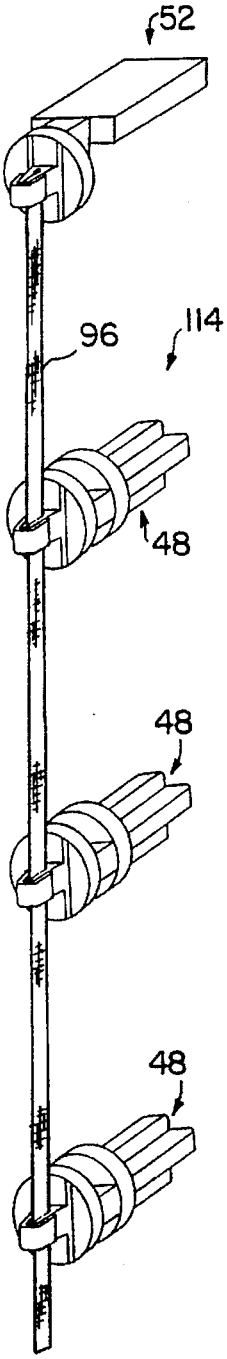
FIG. 11 is a perspective view of the guiding components of the preferred embodiment operably connected by a system connecting belt.

Referring now to FIGS. 10*a*–10*c* there is shown an enlarged view of the body portion 100 of the guide elements 48 and 52. The cap 106 is a U-shaped member in plan-view having a grooves 108 on opposed sides of the member. The teeth or prongs 104 extend from the cylindrical guide portion 102 as shown. Grooves 103 formed at the base of the prongs 104 permit flexibility in the prongs 104. The head portion of the prongs are flat on their lateral sides for engagement with the cap 106 and the belt 96. Preferably, gripping serrations are provided on the inner grip side of the prong head in order to prevent sliding of the belt.

During the assembly stage, a connecting belt 112 (note FIG. 11) is first placed in between the prongs 104 of each of the guide elements 48, 52. Thereafter, the opposing prongs 104 are forced toward each other against the resistance provided by the construction material (preferably a commercial plastic or other similar material) and the grooves 103, thereby gripping the belt 96 between the teeth 104. The cap 106 is then forced onto the mating heads of the prongs 104 until the head bumps 105 snap into the cap grooves 108. It is to be understood that variations of the cap 106 and prong 104 structures can be made in order to accomplish the desired belt locking function. For example, the cap 104 may be a hemi-spherical or cylindrical structure with corresponding shape modifications to the prongs 104.

In a preferred embodiment the system cover 20 is mounted so as to interact with a lower rail of lower sash 16. Specifically, the distal portion 67 of the short leg of the cover 20 engages a portion of the lower rail of the lower sash 16 such that when the lower sash is raised to open the window, a portion of the lower rail contacts the distal portion 67 of the short leg 66 of the cover 20. This in turn causes the cover 20 to lift with the ascending window sash. This embodiment is preferable because it does not require additional connecting components which connect the cover to the lower rail. If however, the sash design of a particular window does not permit the necessary engagement between the cover and lower sash, an L-shaped prong 86 is provided. Referring to FIG. 4, an L-shaped prong 86 is shown having a hole for attachment to a lower window sash by a screw or the like. The L-shaped member 86 is manufactured from plastic or metal. Once one or more of the L-shaped prongs 86 are attached to the lower window sash 16, the short leg of the L-shaped prong 86 interacts with the distal end portion 67 of the short leg 66 of the cover 20 when the lower window sash 16 is raised.

System cover 20 is a significant improvement over the prior art because it allows for complete housing of the blocking elements 50 when the lower sash 16 is in a lower closed position. In particular, short leg 66 forms an upper portion of a housing and long leg 64 extends downward forming a side portion of a housing to completely enclose blocking elements 50 when the window sash 16 is in a lower closed position. This greatly increases the aesthetic appearance of the safety system over other prior art systems. It is noted, however, that connection to the lower window sash does not necessarily have to derive from cover element 20. If an additional element is provided which connects the system to the lower window sash 16 then cover 20 is not needed. For example, the blocking elements could be secured to the lower rail of the lower window sash and housed in an internal cavity formed in the lower rail.

Figure 12A:
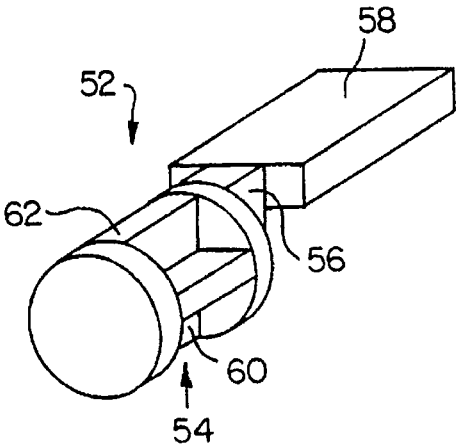
FIGS. 12A–12C are perspective, side, and top views, respectively, of a cover guide element of an alternative embodiment of the window safety system of the present invention.
Figure 12B:
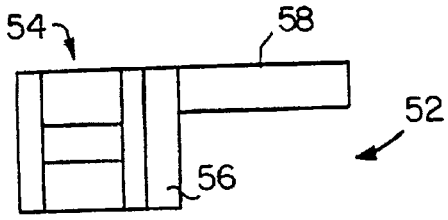
Figure 12C:
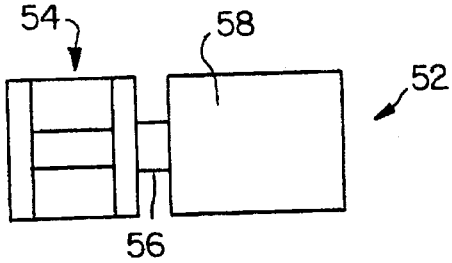

Referring now to FIGS. 12*a*, 12*b* and 12*c* there is shown an alternative construction of a cover guide element 52 of the present invention. The guide element 52 of the alternative embodiment (like reference numerals indicating identical parts) comprises a body 54, throat 56, and attachment 58 portion. The body 54 of the alternative embodiment is cylindrical in shape in order to provide sufficient guiding within the channel of tracks 22, 24 while minimizing contact with the surfaces of the channel for reduction of sliding friction. As shown in FIGS. 12*a*–12*c*, the body 54 is most preferably provided with a series of grooves 60 and ridges 62 in order to maximize guidance within the channel of the tracks 22, 24 and minimize friction, friction, and quantity of material. The attachment portion 58 of the cover guiding element 52 operably engages the cover 20 as described with reference to FIGS. 8*a*–8*c*.

Figure 13A:
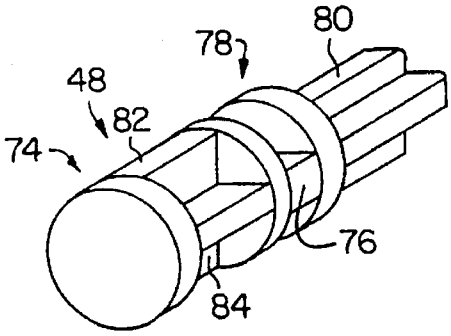
FIGS. 13A–13C are perspective, side, and top views, respectively, of a guide element of an alternative embodiment of the window safety system of the present invention.
Figure 13B:
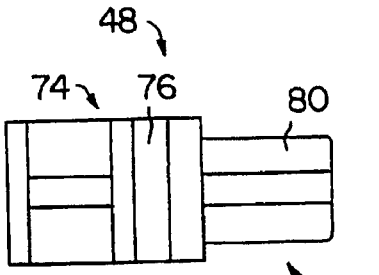
Figure 13C:
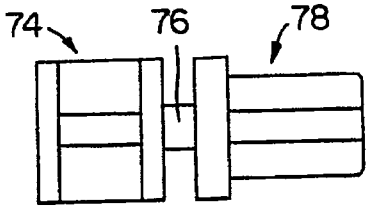

FIGS. 13*a*–13*c* depict an alternative embodiment of guiding elements 48. Specifically, guide element 48 comprises a body 74, throat 76, and attachment portion 78. The guide element 48 is preferably an integral component manufactured from a plastic and is cylindrical in shape for guidance within the channel of the tracks 22, 24 in the same manner as cover guide element 52 described above with reference to FIGS. 12*a*–12*c*. The body portion 74 of the guide 48 is provided with grooves 82 and ridges 84 in order to maximize guidance within the channel of the tracks 22, 24 and minimize friction, weight, and quantity of material. The blocking elements 50 cooperate at their ends with the attachment portion 78 of the guide elements 48 in the identical manner described with reference to FIGS. 9*a*–9*c*.

Figure 14:
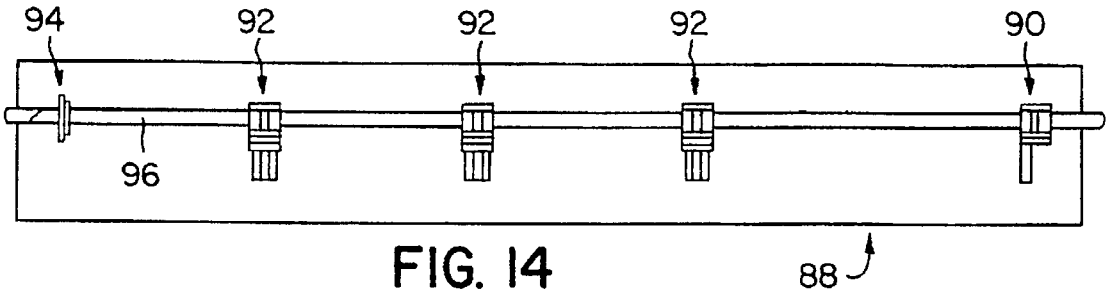
FIG. 14 is a perspective view of the guiding components of the alternative embodiment formed as an integral unit of the window safety system of the present invention.
Figure 15:
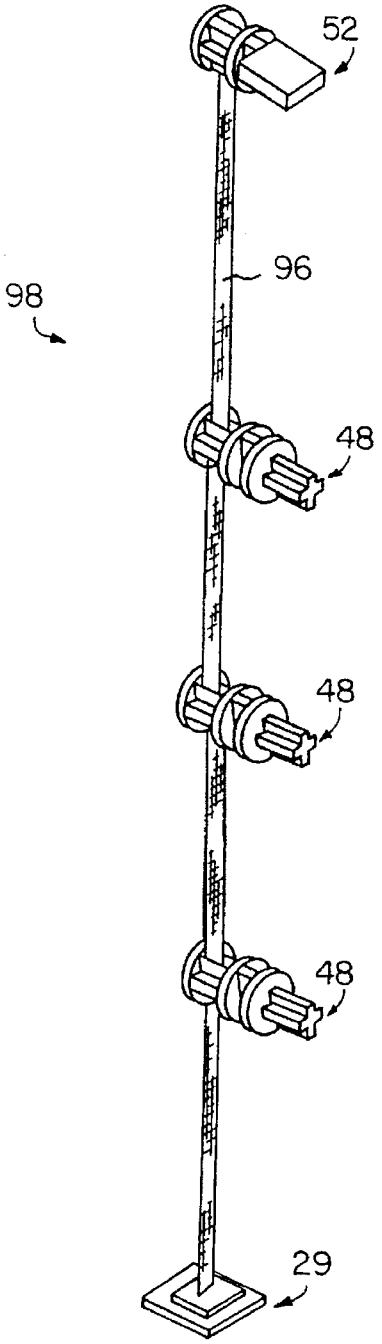
FIG. 15 is a schematic view of the component assembly mold of the window safety system of the alternative embodiment of the present invention.

The guiding elements 48 and 52 of the alternative embodiment are preferable manufactured as a single unit 98 as described with reference to FIG. 14. There is shown a manufacturing mold 88 for producing the guiding elements of the alternative embodiment. In this process, the cover guide element 52, the guide elements 48, and the lower track cap 29 are manufactured as an integral unit in a single mold 88. Specifically, the mold 88 is an elongate mold having a cover guide element forming section 90, a plurality of blocking guide element forming sections 92, and a track base forming section 94. The sections 90, 92, and 94 are spaced apart according to the separation distance desired between the cover 20 and the blocking elements 48. The mold 88 is designed to allow for a connecting belt 96 to be placed within the mold during the forming process. The mold is provided with a longitudinal groove which extends through the molding sections. Prior to injection of the plastic, the connecting belt 96 is placed through forming section 90 and forming sections 92 and 94. The belt 96 is placed in forming sections 90 and 92 such that it occupies the mold space which forms the body portions 52 and 74 of the cover guide element 52 and the guide elements 48 respectively. Once the belt 96 is properly positioned, the mold 88 is closed and a liquid plastic material is injected into the mold sections 90, 92, and 94. After curing is complete, the mold 88 is opened and the system components are removed as a single integral guide unit 98 as shown in FIG. 15. Connecting belt 96 is formed from fabric or cloth, preferably nylon. The connecting belt 96 is a significant improvement over prior art systems in that it allows for a flexible and resilient connection between system components and for controlled deployment of the blocking elements 50.

As noted above, the window safety system 12 of the present invention can be easily installed in existing windows 10 without any significant modification to existing window structure. First, the system user determines the required length of the vertical tracks 22, 24 in accordance to the measurements of the window 10. If necessary, the vertical tracks 22, 24 are cut to the desired length by a system user using a conventional fine tooth saw. While still removed from the window 10, the track 22 next receives cover guiding element 52 and at least one guide element 48 which are operably connected by belt 96. The cover guiding element 52 is first inserted in the channel at the lower end of the tracks 22, 24. The cover guide element 52 is then raised whereby the guide elements 48 are consecutively inserted into the channel. The system user then secures the lower track bases 29 to the bottom of the tracks 22, 24 by force fitting the bases into the channel of the tracks. Next, the user determines, depending on the width of the window 10, if cutting of the blocking elements 50 and cover 20 will be necessary. If necessary, the blocking elements 40 and the cover 20 are cut to the desired length by a system user using a conventional fine tooth saw. The distal ends of the cover 20 are then secured to respective cover guide elements 52. Specifically, referring to FIGS. **8*b*–8*c*, the attachment portions 58 of the cover guide elements 52 are snapped into the channel 70 defined by the short leg 66 and the extension 68 of the cover 20. The lip 72 of the extension 68 assures that the attachment portion 58 is securely locked in position. The blocking elements 50 are next secured at their distal ends to the guiding elements 48. The tubular elements 50 are inserted over and onto the cylindrical prong 80 of the guiding elements 48. The system user then secures the mounting bases 28 on an inner surface of the window frame 26. Preferably, screws are used which are inserted through screw hole 34 of the base plate 28. The number of base plates 28 used will depend on final length of the vertical tracks 22, 24. Preferably, however, three base elements 28 are utilized. The system assembly consisting of the vertical tracks 22, 24, unit 98 or 114, secured cover 20 and blocking elements 50 is then installed in the window 10 by sliding channel 36 of the vertical tracks 22, 24 over the base elements 28. The upper track cap 29 is then placed over the distal end opening of the vertical track 22, 24. If needed, the L-shaped prong 86 is secured to the lower rail of the lower sash 16 in order to allow the cover 20 and sash 16** to operably engage one another for system activation. At this point system installation is complete and fully operational.

In operation, the safety system of the present invention is easily activated by an adult home occupant. The system is activated when the vertical tracks have been installed as described and the extended portion 67 of the cover element 20 engages a portion of a lower rail of the lower sash 16 or prong member 86 secured to the lower sash 16. When a home occupant opens the window by grasping the lower window sash 16 and pulling upward, an engaging portion of the lower rail or the prong member 86 of the lower window sash catches the extended portion 67 of the cover 20 which causes the cover 20 to follow the lower rail's ascending movement. The movement of the cover 20 in turn causes the cover guiding elements 52 to move upward within the vertical tracks 22, 24. A first guide element 48 is then caused to move upward due to its connection through connecting belt 98. In a safety system utilizing more than one blocking element, if the window is further raised then the tension on the belt 98 causes an additional guide element 48 to travel upward within track 22, 24 and so on. The movement of the guide elements 48 in an upward direction causes the corresponding attached blocking elements 50 to lift upward and occupy the opening of the window.

When the window sash 16 is in a raised position the blocking elements occupy the space of the window opening thereby preventing a small child from passing through and accidently falling out the window. Furthermore, if a child is curious and grabs onto the blocking elements 50 in an attempt to climb up onto the window sill, the window will merely close itself rendering the window safe. In this, constant parental guidance is not necessary if the safety system has been activated.

The window safety system 12 of the present invention provides a safe and reliable way to prevent a small child, mentally impaired adult, pet or the like from falling out a window. The system places blocking elements 50 across the opening of a window in an automatic fashion thereby preventing egress. If, however, it is required to deactivate the window safety system 12—for example, if emergency exit out the window is required or for routine window maintenance—the system provides for a quick and reliable way to do so. Referring to FIGS. **8*b* and 8*c* there is shown a method for deactivating the safety system 12 of the present invention. As described above, the system cover 20 is secured to the attachment portion 58 of the cover guide element 52 by snapping the attachment portion 58 into the channel 70 of the cover 20. Once the cover 20 is secured, the extended portion 67 of the cover interacts with a portion of the lower rail or the prong 86 of the lower sash thereby activating the safety system. When it is desired to deactivate the safety system thereby permitting egress out the opening of the window, the system user grasps the cover 20 along the long leg 64 (note FIG. 8*b*) and pulls in the direction of arrow A (note FIG. 8*c*). The user slides the attachment portion 58 of the cover guide element 52 out of the channel 70 of the cover in order to completely remove the cover 20. In doing so, the blocking elements 48 drop to the sill 18 of the window thereby permitting egress out of the window. The window 10 may now be raised without the placement of the blocking elements 50 across the window opening. When it is desired to reactivate the safety system 12, the user merely snaps the attachment portion 58 of the cover guide element 52 back into the channel 70 of the cover 20**.

The system of the present invention is an additional improvement over prior art designs because it may be manufactured using standard techniques in simple forming dies and molds. Moreover, the system of the present invention contains few parts which allows for easy installations and cost effective manufacturing. The system cover and vertical tracks are preferably manufactured from plastic and are formed in a plastic extrusion process. Similarly, the blocking elements which are preferably tubular are formed of aluminum or plastic. Other materials which are also considered to be within the scope of the invention.

SUMMARY OF MAJOR ADVANTAGES OF THE INVENTION

After reading and understanding the foregoing detailed description of an inventive window safety system in accordance with preferred embodiments of the invention, it will be appreciated that several distinct advantages of the subject window safety system are obtained.

Without attempting to set forth all of the desirable features of the instant window safety system, at least some of the major advantages include providing a window safety system 12 which may easily installed in existing windows 10 without any significant modifications to the existing structure. The window safety system includes a pair of opposed vertical tracks 22 and 24 which are unobtrusively installed on opposing sides of the window frame 26. A safety cover 20 is secured to a cover guide element 52 which guides the cover 20 in the vertical tracks 22 and 24. At least one (preferably three) blocking element 50 is connected at opposing ends to guide elements 48. The cover 20, vertical tracks 22, 24, and blocking elements 50 are all preferably manufactured from plastic or aluminum in order to allow for custom fitting to windows of different dimension. A belt 96 is operably connected to the guide elements 48 and cover guides 52 in order to form a guide unit 98, 114 which is received with the vertical tracks 22, 24. The blocking elements 50 of the safety system 12 of the present invention occupy the opening of the window 10 when the lower sash 16 of the window 10 is raised to open the window 10. In this, the safety system is automatically set in place whether an adult occupant is present or not. Moreover, when the window sash 16 is in a lower closed position, the system cover 20 completely houses the blocking elements 50. The subject design provides for an improved window safety system which, unlike prior art systems, does not detract from the aesthetic appearance of the window 10. Additionally, if a small child grasp the blocking elements 50 in an attempt to climb up onto the window, the lower window sash 16 will simply close thereby rendering the window safe from further climbing by the small child.

An extended portion 67 of the system cover 20 engages a lower rail or an L-shaped prong of a lower window sash such that sash movement is followed by movement of the cover 20. The system 12 may easily be deactivated and/or removed from the window 10 by grasping an underside of the cover 20 and removing an attachment portion 58 of the cover guide element 52 from its restrained position within channel 70 of the cover 20. This novel interaction between the system cover 20 and the cover guide element 52 allows for easy and simple system activation and deactivation by an adult occupant. Such simplicity is essential if a sudden emergency develops, such as a fire, necessitating a fast and safe exit.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A window safety system for use in a window having a frame, upper and lower sash, and a sill, said window safety system being operable to prevent a child, mentally impaired adult, pet or the like from accidentally falling through an open window, said window safety system comprising:

a first vertical track for securing to an inner portion and on one side of the window frame and extending upwardly from the window sill;

a second vertical track for securing to an inner portion and on an opposing side of the window frame and comprising a substantial mirror image of said first vertical track and extending upwardly from the window sill;

at least a first pair of means for guiding wherein at least one of said at least first pair of means for guiding is operably received to translate within said first vertical track and at least the other of said at least first pair of means for guiding is operably received to translate within said second vertical track;

at least one elongated means for blocking egress through the open window having first and second ends operably engaged with said at least first pair of means for guiding such that said first end of said elongate means for blocking is operably connected to a means for guiding received within said first vertical track and said second end of said elongate means for blocking is operably connected to a means for guiding received within said second vertical track;

a second pair of means for guiding wherein one of said second pair of means for guiding is operably received to translate within said first vertical track and the other of said pair of means for guiding is operably received to translate within said second vertical track;

an elongate cover having first and second ends such that said first end is removably secured to one of said second pair of guiding means which translates in said first vertical track and said second end of said cover is removable secured to the other of said second pair of means for guiding which translates in said second vertical track;

first and second connecting means positioned within said first and second vertical tracks such that said first connecting means operably connects said at least one of said at least pair of means for guiding and said one of said second pair of means for guiding which translate within the first vertical track and said second connecting means operably connects said at least the other of said at least pair of means for guiding and said other of said second pair of means for guiding which translate within said second vertical track, whereby when the safety system is installed in a window frame, said elongate cover operably engages the lower window sash such that when said lower window sash in moved from a closed position to an open position, said elongate cover, said second pair of means for guiding, and said at least one pair of first means for guiding are caused to travel upward with said lower window sash which in turn causes said at least one elongate means for blocking to occupy a position laterally across the opening in the window to prevent egress of a child or the like.

2. A window safety system as defined in claim 1 wherein:

said first and second vertical tracks are substantially rectangular in cross-section and comprise a rear panel, two side panels and a pair of opposing extensions which extend from said side panels of said vertical track and which have a longitudinal bearing surface at their distal ends such that an inner guide track is defined by the interaction of the rear panel, side panels, and said pair of extensions, said pair of extensions defining an elongate opening in the side of the track opposed to said rear panel.

3. A window safety system as defined in claim 2 wherein:

said first and second vertical tracks further comprise a second pair of extensions which extend from the rear panel of said track, said second pair of extensions cooperate to form a longitudinal channel for receiving a portion of a track mounting member.

4. A window safety system as defined in claim 3 further comprising:

a track mounting member having a portion which is formed to be slidingly received within the longitudinal channel formed by the second pair of track extensions.

5. A window safety system as defined in claim 1 wherein:

each of said at least first pair of means for guiding comprises a track glide portion, a throat portion, and an attachment portion such that the track glide portion is received within a vertical track and cooperates with said side panels and pair of extensions to provide for smooth travel of the means for guiding within the track, said throat cooperates with said pair of extensions to provide for controlled movement of said means for guiding, and said attachment portion is formed to facilely attach one end of a means for blocking egress.

6. A window safety system as defined in claim 5 wherein:

each of said track glide portions of said first pair of means for guiding comprises at least a generally cylindrical body;

each of said throat portions of said first pair of means for guiding is generally rectangular in cross-section having a long-side and a short-side, said throat portion cooperates with said longitudinal bearing surfaces of said pair of extensions of said track such that the long-side of said throat portion slidingly engages the longitudinal bearing surfaces;

each of said attachment portions of said first pair of means for guiding comprise a generally cylindrical member integrally formed with a protraction which extends from said cylindrical member.

7. A window safety system as defined in claim 6 wherein:

each of said track glide portions of said first pair of means for guiding comprises a generally cylindrical body that is provided with cut-away portions along the inner longitudinal sections of the cylindrical body such that such sections appear t-shaped in cross-section;

the protraction of each of said attachment portions of said first pair of means for guiding is generally t-shaped in cross-section.

8. A window safety system as defined in claim 6 wherein:

the cylindrical body of each of said track glide portions of said second pair of means for guiding is provided with cut-away portions along the inner longitudinal sections of the cylindrical body such that such sections appear t-shaped in cross-section.

9. A window safety system as defined in claim 5 wherein:

each of said track glide portions of said first pair of means for guiding comprises a generally cylindrical body having at least a pair of prongs extending from the body and off a longitudinal axis of said track glide, each of said prongs having a gripping head with a gripping surface, whereby a portion of said connecting means may be placed in between the gripping heads of said prongs and gripped therebetween when said prongs are moved toward the longitudinal axis and in an abutting relationship.

10. A window safety system as defined in claim 9 further comprising:

a locking cap removably secured about the heads of said prongs for maintaining said prongs in said abutting relationship.

11. A window safety system as defined in claim 10 wherein:

said locking cap coprises a U-shaped member in plan view.

12. A window safety system as defined in claim 1 wherein:

said cover comprises an L-shaped member with a short-leg and a long-leg having an extension which is generally parallel with the short-leg of said L-shaped cover, said extension and said short-leg cooperate to form a channel for receiving a portion of one of said second means for guiding.

13. A window safety system as defined in claim 11 wherein:

a distal end of said extension of said cover has a lip which serves to lock said portion of said one of said second means for guiding within said channel.

14. A window safety system as defined in claim 11 wherein:

a distal portion of the short-leg of said cover extends from the long-leg a distance greater than the distance which the extension extends from the long-leg.

15. A window safety system as defined in claim 1 wherein:

said elongate blocking element comprises a tubular member.

16. A window safety system as defined in claim 1 wherein:

said first and second means for guiding are formed from plastic.

17. A window safety system as defined in claim 1 wherein:

said first and second means for guiding are formed from nylon.

18. A window safety system as defined in claim 1 wherein:

said first and second connecting means comprise a flexible belt secured to the said first and second means for guiding.

19. A window safety system as defined in claim 5 wherein:

said first and second connecting means comprise a flexible belt secured to the track glide portion of said first and second means for guiding.

20. A window safety system as defined in claim 1 wherein:

the connecting means is secured to the first and second means for guiding which travel in the first and second vertical tracks such that the connecting means is an integral part of the means for guiding.

21. A window safety system as defined in claim 1 wherein:

there are three pairs of first means for guiding which are operably connected to respective first, second, and third elongate means for blocking.

22. A window safety system as defined in claim 1 wherein:

the vertical tracks and cover are formed from extruded plastic.

23. A window safety system as defined in claim 1 further comprising:

an engagement prong for securing to a lower rail of a lower sash of a window for cooperation with a portion of the elongate cover.

24. A method of manufacturing a window safety system for use in a window having a frame, upper and lower sash, and a sill, said window safety system being operable to prevent a child, mentally impaired adult, pet or the like from accidentally falling through an open window, said method of manufacturing comprising the steps:

(a) forming elongate first and second vertical tracks by extruding a plastic material through a track extrusion die, said first and second vertical tracks for securing to opposing sides of a window frame;

(b) forming an elongate system cover by extruding a plastic material through a cover extrusion die;

(c) forming a plurality of elongate tubular blocking elements by extruding a plastic material through an extrusion die; and (d) forming in a plastic forming mold a guiding unit which comprises a cover guide element, a plurality of guide elements for guiding the tubular blocking means, and a flexible connecting belt, said plastic forming mold having a cover guide forming section, a plurality of guide element forming sections, and a belt receiving groove which extends along the length of the mold through each of said forming sections, said forming step further comprising inserting a connecting belt in said belt receiving groove and injecting a plastic material in each of said mold forming sections whereby after curing of said plastic material, the mold is opened and the integral guiding unit is removed;

whereby when installed in a window frame, a guiding unit is inserted into opposing first and second tracks, the cover is secured at its opposing ends to the cover guide element, and the plurality of tubular blocking elements are secured at their opposing ends to the guide elements.

25. A method of forming a window safety system as defined in claim 24 wherein:

the integral guide unit forming step (d) further includes integrally forming a track cap which covers a lower distal opening in the track.

* * * * *